US006709084B1

(12) United States Patent
Nordlund et al.

(10) Patent No.: US 6,709,084 B1
(45) Date of Patent: Mar. 23, 2004

(54) MEASURING PEN-TO-PAPER SPACING

(75) Inventors: Michael Nordlund, Singapore (SG); Manish Agarwal, Singapore (SG)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/280,334

(22) Filed: Oct. 25, 2002

(51) Int. Cl.[7] ..... B41J 29/393
(52) U.S. Cl. ..... 347/19
(58) Field of Search ..... 347/19, 8, 14, 347/16, 9, 12, 10, 11, 5, 37; 400/55, 56, 59, 23, 35; 356/399–401; 358/504

(56) References Cited

U.S. PATENT DOCUMENTS 5,510,815 A * 4/1996 Linder et al. ..... 347/8
6,003,980 A * 12/1999 Sheinman et al. ..... 347/78
6,196,652 B1 * 3/2001 Subirada et al. ..... 347/19
6,234,602 B1 * 5/2001 Soto et al. ..... 347/19

* cited by examiner

*Primary Examiner*—Stephen Meier
*Assistant Examiner*—Charles Stewart, Jr.

(57) ABSTRACT

A method for measuring a pen-to-paper spacing in an inkjet printing mechanism is provided. Firstly, a first nozzle of a printhead in the printing mechanism ejects a first ink drop onto a medium at a first ejection velocity when the printhead moves at a first moving velocity along a scanning axis and when the printhead reaches a first position along the scanning axis. Subsequently, a second nozzle of the printhead ejects a second ink drop onto the medium at a second ejection velocity when the printhead moves at a second moving velocity along the scanning axis and when the printhead reaches a second position along the scanning axis. The spacing between the two nozzles along the scanning axis and the spacing between the two positions along the scanning axis are predetermined. Then the spacing between the first and second ink drops on the medium along the scanning axis is measured. The pen-to-paper spacing can be determined from the first and second moving velocities, the first and second ejection velocities, the spacing between the first and second nozzles along the scanning axis, the spacing between the first and second positions along the scanning axis and the spacing between the first and second ink drops on the medium along the scanning axis.

5 Claims, 4 Drawing Sheets

MEASURING PEN-TO-PAPER SPACING

BACKGROUND

This invention relates generally to inkjet printing mechanisms, and in particular to techniques for measuring a pen-to-paper spacing.

Inkjet printing mechanisms such as thermal inkjet printers and piezoelectric printers use printheads to eject drops of liquid colorant, referred to generally herein as "ink," onto a media sheet. Each printhead is formed with very small nozzles through which the ink drops are fired.

As shown in FIG. 2, in this application, a pen-to-paper spacing (PPS) 205 is defined as the spacing between the printhead 110 of an inkjet printing mechanism and an upper surface 203 of a media sheet 201 in a print zone 106. It is understood that the large variations in part manufacturing and the dependency of print quality on PPS make it a critical parameter to be adjusted at the printer manufacturing stage.

Present day methods use expensive tools such as laser-based linear variable differential transducers (LVDTs) or high precision mechanical LVDTs to measure the PPS. This process includes multiple measurements across the print zone on a special calibrated media sheet being fed through the printing mechanism.

However, the use of these additional tools adds extra costs to the printer manufacturing process, apart from making PPS measurement a very manual and time-consuming procedure, and requires constant operator involvement. All these may not be desirable to the manufacturer.

Therefore, there is a need for a more convenient and less expensive way of measuring the PPS in an inkjet printing mechanism.

SUMMARY

According to an aspect of the invention, a method for measuring a pen-to-paper spacing in an inkjet printing mechanism is provided. Firstly, a first nozzle of a printhead in the printing mechanism ejects a first ink drop onto a medium at a first ejection velocity when the printhead moves at a first moving velocity along a scanning axis and when the printhead reaches a first position along the scanning axis. Subsequently, a second nozzle of the printhead ejects a second ink drop onto the medium at a second ejection velocity when the printhead moves at a second moving velocity along the scanning axis and when the printhead reaches a second position along the scanning axis. The spacing between the two nozzles along the scanning axis and the spacing between the two positions along the scanning axis are predetermined. Then the spacing between the first and second ink drops on the medium along the scanning axis is measured. The pen-to-paper spacing can be determined from the first and second moving velocities, the first and second ejection velocities, the spacing between the first and second nozzles along the scanning axis, the spacing between the first and second positions along the scanning axis and the spacing between the first and second ink drops on the medium along the scanning axis.

Other aspects and advantages of the invention will become apparent from the following detailed description, taken in conjunction with the accompanying drawings, illustrating by way of example the principles of the invention.

DETAILED DESCRIPTION

For convenience, the concepts of the present invention are illustrated in the environment of an inkjet printer 100, while it is understood that the present invention as illustrated by the exemplary embodiment can also be used in other inkjet printing mechanisms such as facsimile machines and copiers.

While it is apparent that the printer components may vary from model to model, the typical inkjet printer 100 includes a chassis 104 surrounded by a housing or casing enclosure 102.

The printer 100 also has a printer controller, illustrated schematically as a microprocessor 118, which receives instructions from a host device, typically a computer, such as a personal computer (not shown), and manages different operations of different components of the printer 100.

Figure 1:
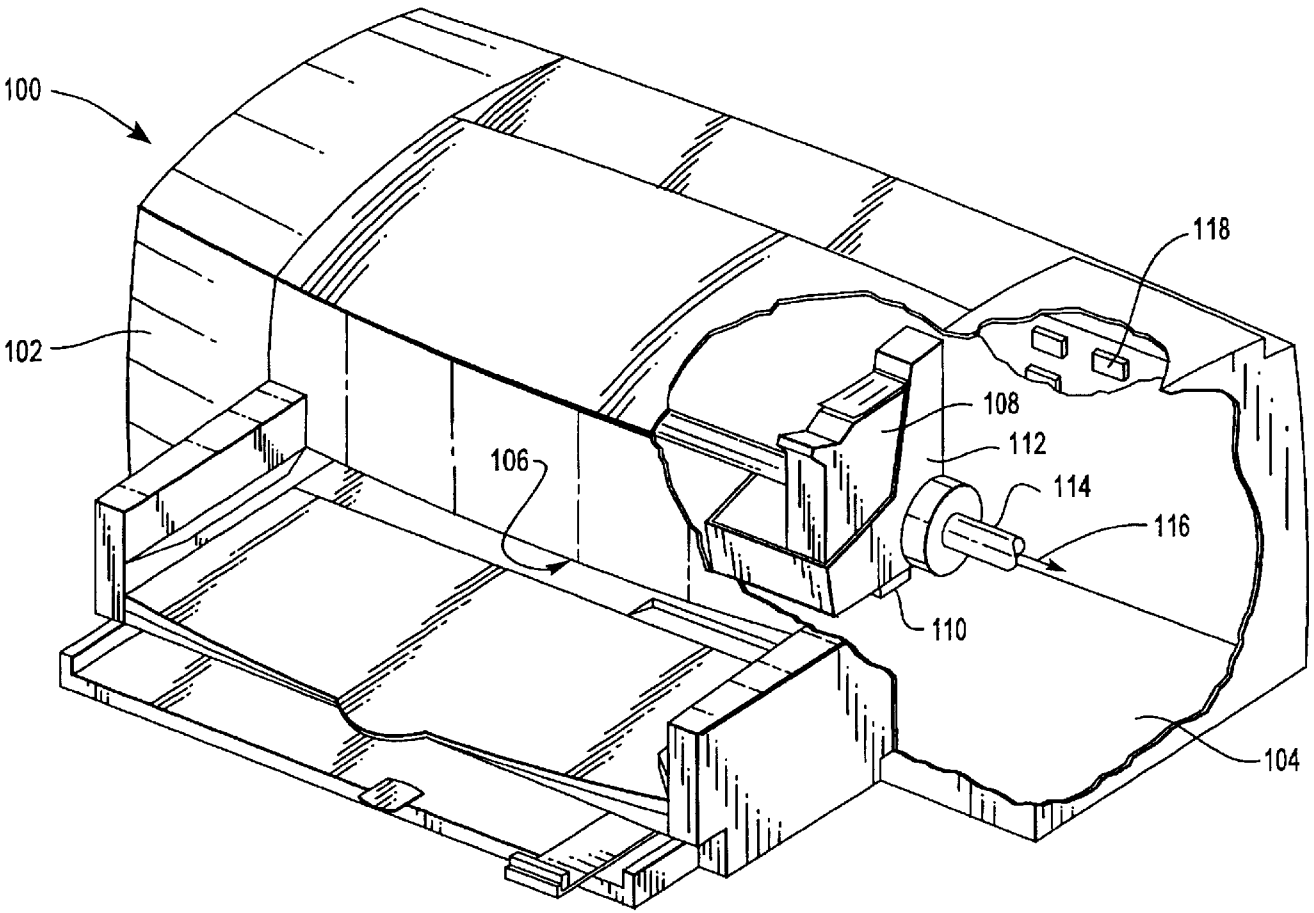
FIG. 1 is a fragmented, partially schematic, perspective view of one form of an inkjet printer in which an exemplary embodiment of the invention can be implemented.

In a print zone 106, a media sheet (not shown in FIG. 1) receives ink drops from an inkjet cartridge 108 on the carriage. The cartridge 108 is also often called a "pen" by those in the art. The illustrated pen 108 includes a reservoir (not shown) for storing a supply of ink. The pen 108 also has a printhead 110, which has an orifice plate 300 (see FIG. 3) with a plurality of nozzles 302 (see FIG. 3) formed therethrough in a manner well known to those skilled in the art. The illustrated printhead 110 is a thermal inkjet printhead, although other types of printheads may be used, such as piezoelectric printheads. The printhead 110 typically includes a substrate layer having a plurality of resistors (not shown), which are associated with the nozzles 302. Upon energizing a selected resistor, a bubble of gas is formed to eject a droplet of ink from the nozzle at a certain velocity and onto the media sheet in the print zone 106. The printhead resistors are selectively energized in response to enabling or firing command control signals. The control signals may be delivered by a conventional multi-conductor strip (not shown) from the controller 118 to the printhead carriage 112, and through conventional interconnects (not shown) between the carriage and the pen 108 to the printhead 110. Furthermore, the controller 118 maps the firing information to the appropriate nozzles and coordinates the nozzles firing to pre-determined locations.

A carriage guide rod 114 is supported by the chassis 104 to slidably support the inkjet carriage 112 for travel back and forth across the print zone 106 along a scanning axis 116 defined by the guide rod 114. To provide carriage positional feedback information to the printer controller 118, an optical encoder reader (not shown) may be mounted to the carriage 112 to read an encoder strip extending along the path of carriage travel. Furthermore, an optical sensor (not shown) can be attached to the carriage 112 for the purpose of, for example, pen alignment.

Figure 2:
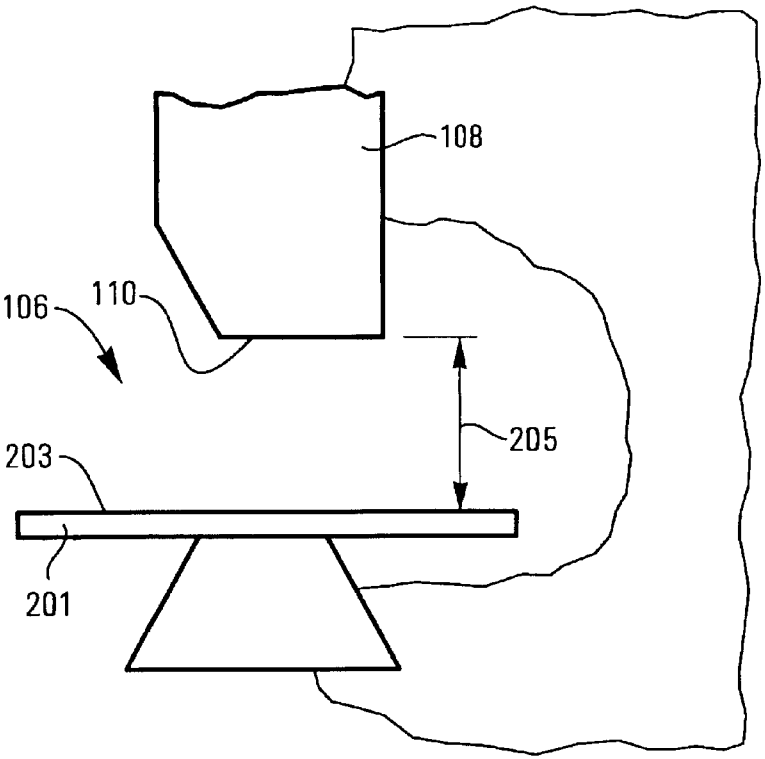
FIG. 2 is a side view illustrating the printhead printing on a media sheet having an upper surface to define PPS in the printer of FIG. 1.

As shown in FIG. 2, for the purpose of this application, a pen-to-paper spacing (PPS) 205 is defined as the spacing between the printhead 110 and an upper surface 203 of the media sheet 201 in the print zone 106.

Figure 3:
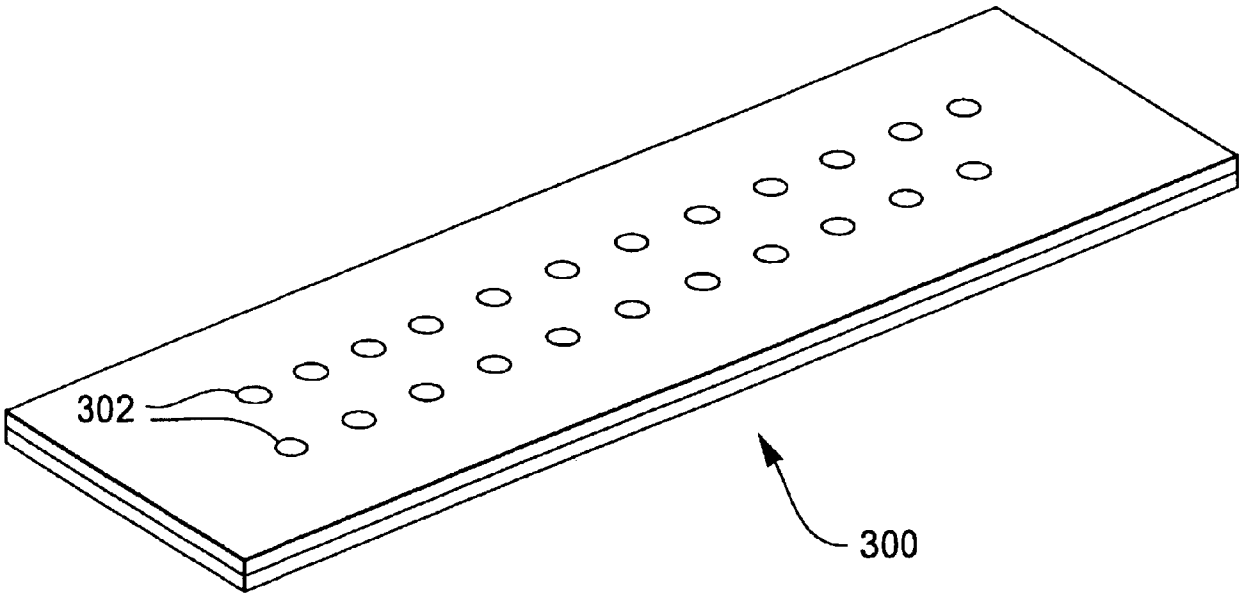
FIG. 3 is a perspective view of an orifice plate with nozzles thereon.

FIG. 3 illustrates the orifice plate 300 of the printhead with nozzles 302 formed therethrough.

Figure 4:
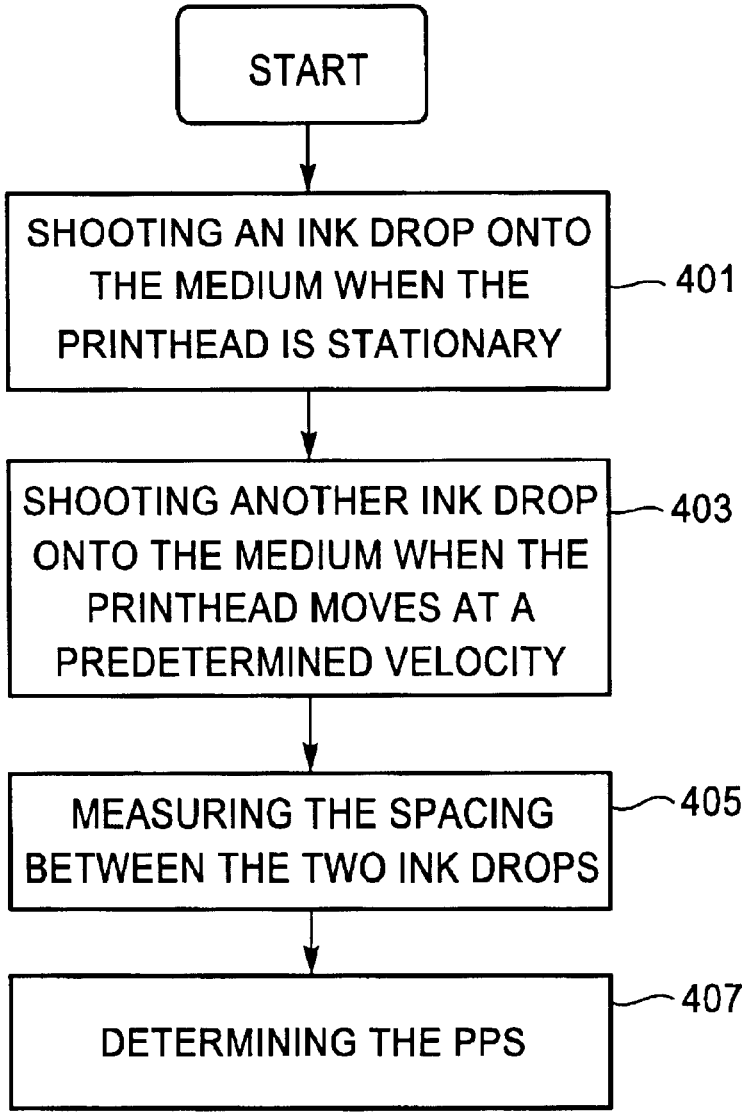
FIG. 4 is a flow chart illustrating an exemplary process of measuring PPS.

FIG. 4 shows a flow chart illustrating an exemplary process of measuring PPS. In the initial step 401, both the carriage and the printhead remain stationary at a pre-selected position along the scanning axis, and the controller of the printer selects a first nozzle to eject a first ink drop onto the media sheet in the print zone at a predetermined ejection velocity V1. Subsequent to this ejection, the carriage, as well as the printhead, moves at a predetermined moving velocity U1 along the scanning axis across the print zone. In a second step 403, when the carriage reaches the pre-selected position along the scanning axis, the controller controls the first nozzle, which ejected the first ink drop, to eject a second ink drop onto the media sheet at the predetermined ejection velocity V1 while the carriage, as well as the printhead supported by the carriage, is moving at the moving velocity U1. After these two ejection steps, in a third step 405, the controller controls to measure the spacing D along the scanning axis between the first and second ink drops on the media sheet by, for example, moving the optical sensor attached to the carriage over the media sheet for measurement. After D is ascertained, in a final step 407, the controller calculates the PPS according to the following formula:

$$PPS=D*V1/U1.$$

In this way, PPS is automatically measured by using elements, which are already available in the inkjet printer, without introducing new parts to the printer.

Alternatives can be made to the above exemplary process. For example, if the ejection velocity of the ink drops can be adjusted, in the first ejection step, the printhead, along with the carriage, may move at a first moving velocity U1 and shoot the first ink drop at a first ejection speed V1 when the printhead or the carriage reaches a first ejection position along the scanning axis. In the second ejection step, however, the printhead moves at a second moving velocity U2 and shoots the second ink drop at a second ejection speed V2 when the printhead or the carriage reaches a second ejection position along the scanning axis. The spacing X between the first and second ejection positions along the scanning axis is predetermined, and the spacing D between the two ink drops on the media sheet along the scanning axis is also ascertained. Furthermore, if the printhead moves in a same direction along the scanning axis during these two ejection steps, the ratio of V1 to U1 should be different from the ratio of V2 to U2, and in that case, the PPS can be calculated according to the following formula: PPS=(D−X)(V1*V2)/(U2*V1−U1*V2). If the printhead moves in different directions along the scanning axis during the two ejection steps, the PPS can be calculated in a similar way. It is noted that the velocities U1, U2, V1 and V2 are vectors and hence each takes a positive or negative value depending upon the sign convention being followed. It is further noted that the scanning axis along which the printhead travels is presumably parallel to the media sheet in the print zone and that the printhead plane defined by the orifice plate of the printhead is also presumably parallel to the media sheet in the print zone.

Also, the controller may control two different nozzles to eject the first and second ink drops during the first and second ejection steps respectively. In that case, the spacing along the scanning axis between these two nozzles, which can also be pre-determined relatively easily, needs to be considered when the PPS is calculated.

In addition, instead of ejecting a single ink drop by a single nozzle, a group of nozzles can be used to print a predetermined pattern onto the media sheet during each ejection step. In this case, the ejection velocities of each of the nozzles within the group need to be equivalent.

What is claimed is:

1. A method comprising:

ejecting a first ink drop onto a medium at a first ejection velocity by a first nozzle of a printhead in the printing mechanism when the printhead moves at a first moving velocity along a scanning axis and when it reaches a first position along the scanning axis, ejecting a second ink drop onto the medium at a second ejection velocity by a second nozzle of the printhead when the printhead moves at a second moving velocity along the scanning axis and when it reaches a second position along the scanning axis, wherein the spacing between the two nozzles along the scanning axis and the spacing between the two positions along the scanning axis are predetermined, measuring the spacing between the first and second ink drops on the medium along the scanning axis; and determining the pen-to-paper spacing from the first and second moving velocities, the first and second ejection velocities, the spacing between the first and second nozzles along the scanning axis, the spacing between the first and second positions along the scanning axis and the spacing between the first and second ink drops on the medium along the scanning axis.

2. The method of claim 1, wherein if the printhead moves in a same direction along the scanning axis during the two ejection steps, the ratio of the first moving velocity to the first ejecting velocity is different from the ratio of the second velocity to the second ejecting velocity.

3. The method of claim 1, wherein the first and second nozzles are the same nozzle.

4. The method of claim 1, wherein the first and second positions are the same.

5. The method of claim 1, wherein the first and second ejecting velocities are the same.

* * * * *